US006004223A

United States Patent [19]

Newcomb

[11] Patent Number: 6,004,223

[45] Date of Patent: Dec. 21, 1999

[54] GOLFBALL STENCIL

[76] Inventor: Nelson F. Newcomb, 42 Ocean Dr., Jupiter Colony Inlet, Jupiter, Fla. 33469

[21] Appl. No.: 08/982,982

[22] Filed: Dec. 2, 1997

[51] Int. Cl.[6] ..... A63B 69/36; B05C 17/06

[52] U.S. Cl. ..... 473/257; 473/218; 473/268; 473/280; 473/353; 101/127; 101/DIG. 40; 40/327

[58] Field of Search ..... 473/353, 268, 473/200, 218, 257, 280, 357; 101/127, DIG. 40; 40/327

[56] References Cited

U.S. PATENT DOCUMENTS

| | | | |
|---|---|---|---|
| 676,506 | 6/1901 | Knight et al. | 473/268 |
| 849,600 | 4/1907 | Cory . | |
| 943,851 | 12/1909 | West . | |
| 1,045,340 | 11/1912 | Supplee . | |
| 1,096,084 | 5/1914 | West . | |
| 1,139,689 | 5/1915 | Lyon . | |
| 1,228,736 | 6/1917 | Bacheller et al. . | |
| 1,286,205 | 12/1918 | Beaver . | |
| 1,339,569 | 5/1920 | Lyon . | |
| 1,390,926 | 9/1921 | Beach . | |
| 1,427,461 | 8/1922 | Henderson . | |
| 1,476,203 | 12/1923 | Horne . | |
| 1,527,691 | 2/1925 | McNab et al. . | |
| 1,537,685 | 5/1925 | Ladd . | |
| 1,641,562 | 9/1927 | Will et al. . | |
| 1,814,170 | 7/1931 | Long . | |
| 1,814,312 | 7/1931 | Heene . | |
| 1,921,571 | 8/1933 | Jones | 197/6.2 |
| 1,953,992 | 4/1934 | Seagers | 197/6.2 |
| 1,999,647 | 4/1935 | Atti | 197/47 |
| 3,647,221 | 3/1972 | Holley | 273/235 |
| 4,086,851 | 5/1978 | Brandell | 101/4 |
| 4,441,716 | 4/1984 | Chen | 273/183 |
| 4,803,922 | 2/1989 | Dennesen | 101/41 |
| 5,450,791 | 9/1995 | Prohm | 101/333 |
| 5,564,707 | 10/1996 | Dinh | 473/353 X |

*Primary Examiner*—George J. Marlo
*Attorney, Agent, or Firm*—Ernest V. Linek; Banner & Witcoff, Ltd.

[57] ABSTRACT

An alignment aid for golfers consisting of a rigid hemispherically shaped body having two intersecting slits therein for making a mark on a golf ball which indicates the intended path of the golf ball and the preferred orientation of the club face for obtaining the intended path of the golf ball.

4 Claims, 2 Drawing Sheets

GOLFBALL STENCIL

BACKGROUND OF THE INVENTION

1. Field of the Invention

The present invention relates to a golf ball marking device. Specifically this invention relates to a golf stencil for marking a golf ball as a playing aid for golfers, which dictates exact club alignment in two positions; (a) line of stroke and (b) square to the club face.

2. Background

Heretofore it was known in the prior art to place various markings on a golf ball for various purposes. See for example the golf balls of U.S. Pat. Nos. 5,662,530; 5,564,707; 4,258,921; 4,209,172; 3,753,565; 3,420,529; 2,709,595; 1,842,944 and 676,506; the disclosures of which are hereby incorporated herein by reference.

Typical of such prior art devices is the centerplane markings of Hsi-Chou (U.S. Pat. No. 4,974,511), and the calibrated grid of Chen (U.S. Pat. No. 4,441,716). The principal drawbacks of these prior art devices lies in their complexity in marking the ball, and in the case of Chen, using the marked ball. The His-Chou device utilizes an electric motor-driven for determining the center of gravity of a golf ball, so that the ball can be struck in the centerplane to ensure true flight. Chen utilizes a complex grid pattern placed on the ball or on a ball holder which allows the golfer to gauge where the ball is being hit. Neither system addresses how to have the golfer find the true putting line on a green.

Other devices have been marketed for novelty marking of golf balls, or for the placement of initials on a golf ball for identification purposes, such as in Cory (U.S. Pat. No. 849,600) and West (U.S. Pat. No. 943,851). None of these patents discuss aiding the golfer in putting true, i.e., utilizing both the intended path of the golf ball, and the position of the putter face.

SUMMARY OF THE INVENTION

Now there is provided by the present invention a golf ball alignment marker stencil for placing a mark on a golf ball for use by the golfer, particularly as an alignment aid during the striking of the ball and especially during putting.

It is therefore a principal object of the present invention to provide a novel stencil for marking a golf ball. It is another object of the present invention to provide a stencil for marking a golf ball with a right-angle crosshair pattern, with one line of the crosshair for marking the intended path of the golf ball when putted, and the other line indicating the preferred orientation of the club face for obtaining the desired path of the ball when putted. Other aspects of the invention are disclosed below.

BRIEF DESCRIPTION OF THE DRAWINGS

These and other features and advantages of the present invention will become more apparent in view of the following detailed description in conjunction with the accompanying drawing, of which.

DETAILED DESCRIPTION OF AN ILLUSTRATIVE EMBODIMENT

The present invention will be described herein with reference to an illustrative embodiment of a golf ball stencil which follows.

Figure 1:
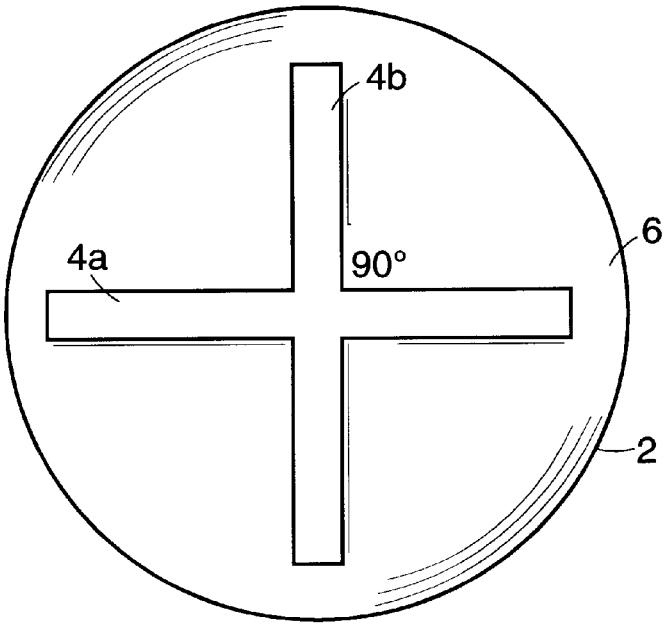
FIG. 1 is a top plan view of the golf ball stencil according to an illustrative embodiment of the instant invention.

Referring to FIG. 1, there is shown the golf ball stencil of the present invention generally referred to as numeral 2. The stencil is generally of the shape of a hollow hemisphere, and in an illustrative embodiment comprises two slits 4*a* and 4*b* disposed crossing each other at their midpoints and forming a 90° angle. In a preferred embodiment, the slits are approximately ⅛" wide, and will accommodate a marking instrument such as a felt tip pen. In addition, in a preferred embodiment, the slits have a terminus situated about ⅛" above the equatorial perimeter of the hemisphere, forming a runner 6. Of course, other orientations, shapes and sizes are possible. For example, the stencil could comprise unequal-length and/or width slits and may form more detailed indicia or graphics. The markings might be formed by, for example, spray painting, airbrushing, stamping, etching, scoring, or any other method for imparting indicia to a surface using the stencil as a guide. In a preferred manner of use, the golfer would mark a ball before play, using a permanent felt-tip marking pen or the like. Different colored markings would be used by member of a foursome to distinguish each ball in play.

Figure 2:
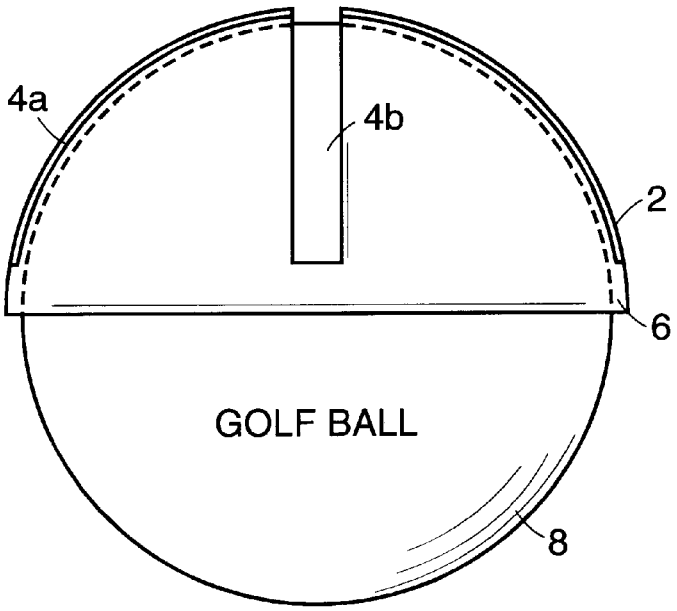
FIG. 2 is a side elevation view of the ball stencil overlying a golf ball according to an illustrative embodiment of the instant invention.

Referring to FIG. 2, the stencil 2 is shown overlying a standard golf ball 8. Ball 8 may be of conventional size and shape with dimples, or may be a practice ball of smooth surface. In FIG. 2, it can be seen that a marking device can be guided across the surface of the ball by the slits 4*a* and 4*b* to form a cross on the ball. In a preferred method, ink by means of a felt marker or swab is spread over the surface of the ball inside the slits 4*a* and 4*b*. The surface finish of the stencil 2 may advantageously be formed of a material selected so as to repel ink for easy cleaning. Utilizing the preferred method, the indicia is dry after a few seconds, and the ball is ready to be used in play.

In utilizing the ball, the present invention is particularly useful to assist the golfer in putting. The markings can likewise serve to assist driving, as well as fairway shots, as the indicia on the ball assists the golfer in getting the head of the golf club squared to the intended line of ball path direction.

Figure 3:
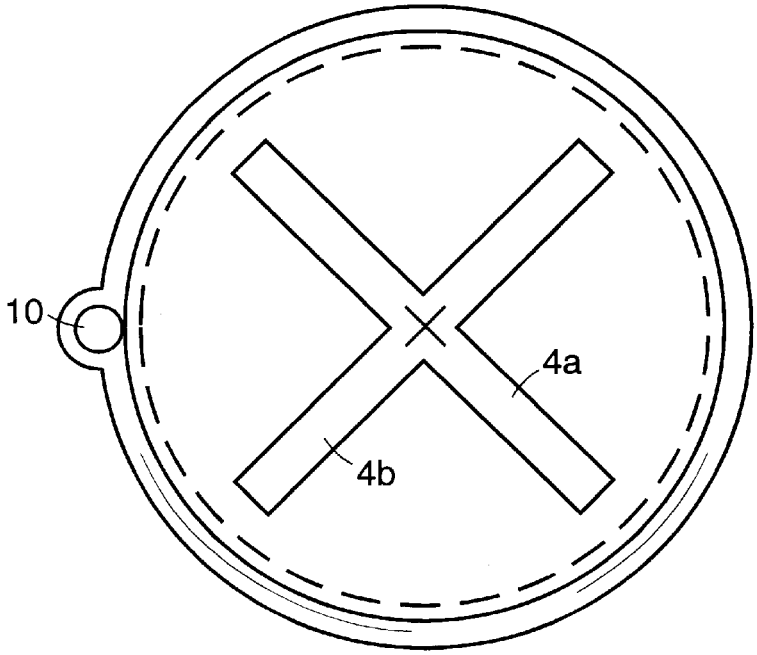
FIG. 3 is a top plan view of the golf ball stencil according to a second illustrative embodiment of the instant invention.

Referring to FIG. 3, a second illustrative embodiment is disclosed. The embodiment comprises all of the elements of the embodiment described hereinabove with the addition of a loop 10 which can advantageously be used to secure the marking stencil to the golf bag or other utility hook for easy access and convenient storage. Of course, many other securing means may be used in the place of the loop including but not limited to hooks, strings, cords, or clips.

Figure 4:
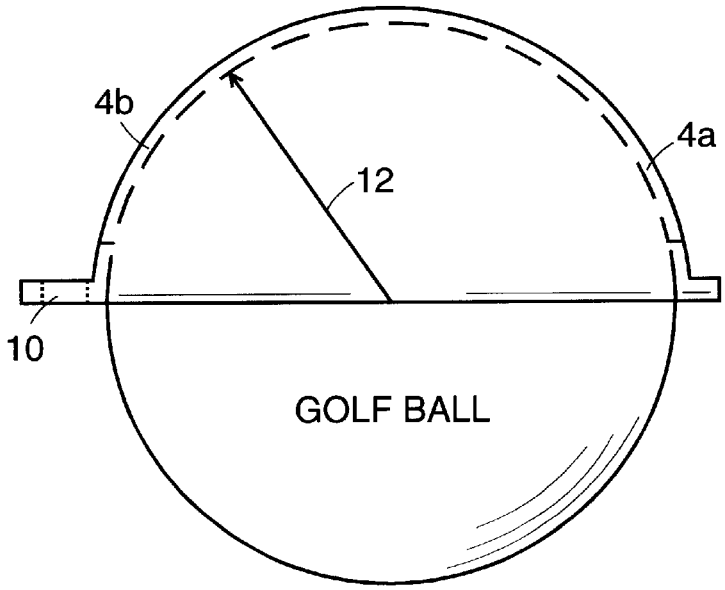
FIG. 4 is a side elevation view of the ball stencil in situ overlying a golf ball according to a second illustrative embodiment of the instant invention.

FIG. 4 shows the second preferred embodiment fitted atop a golf ball 8. As can be seen by the radius line 12, the inside radius of the stencil 2 is approximately equal to the outside diameter of the ball 8, with additional clearance provided for facile introduction and removal of the ball, but preferably allowing for a snug fit such that the stencil will remain relatively stable during marking of the ball surface.

Although the invention has been shown and described with respect to exemplary embodiments thereof, various other changes, additions and omissions in the form and detail thereof may be made therein without departing from the spirit and scope of the invention.

What is claimed is:

1. An alignment aid for golfers consisting of a rigid hollow hemispherically shaped body having two intersecting slits therein, said slits forming a plus sign (+) shaped opening for making a plus sign (+) shaped marking on a golf ball, and wherein said hollow body is of a sufficient size to accommodate a portion of a golf ball therein and said marking has dimensions sufficient to indicate to a golfer addressing a golf ball including said marking, the intended path of said golf ball and the preferred orientation of the club face for obtaining said intended path.

2. The golf ball stencil of claim 1, wherein said hollow body will accommodate up to about one-half of a golf ball therein.

3. The golf ball stencil of claim 1, wherein the slits are both about ⅛ inch wide.

4. The golf ball stencil of claim 3, wherein the slits are both about 2¼ inches long.

* * * * *